United States Patent [19]

Ishii et al.

[11] Patent Number: 4,679,281

[45] Date of Patent: Jul. 14, 1987

[54] AUTOMATIC LOCKING SLIDER WITH A PAIR OF PULL TABS

[75] Inventors: Susumu Ishii, Kurobe; Kiyoshi Oda, Namerikawa, both of Japan

[73] Assignee: Yoshida Kogyo K. K., Tokyo, Japan

[21] Appl. No.: 860,579

[22] Filed: May 7, 1986

[30] Foreign Application Priority Data

May 24, 1985 [JP] Japan ..... 60-76408[U]

[51] Int. Cl.[4] ..... A44B 19/30

[52] U.S. Cl. ..... 24/422; 24/419

[58] Field of Search ..... 24/422, 437, 419, 429, 24/438

[56] References Cited

U.S. PATENT DOCUMENTS

| | | | |
|---|---|---|---|
| 1,589,498 | 6/1926 | Whitney | 24/419 |
| 2,277,818 | 3/1942 | Carlile | 24/419 |
| 2,423,210 | 7/1947 | Ulrich et al. | 24/422 |
| 2,799,070 | 7/1957 | Weber | 24/422 |
| 2,864,146 | 12/1958 | Morin | 24/422 |
| 2,890,512 | 6/1959 | Stilwell | 24/419 |
| 2,953,831 | 9/1960 | Morin | 24/422 |
| 3,129,480 | 4/1964 | Carlile | 24/422 |
| 4,123,828 | 11/1978 | Akashi | 24/422 |

FOREIGN PATENT DOCUMENTS 5637606 9/1981 Japan .

*Primary Examiner*—Victor N. Sakran

*Attorney, Agent, or Firm*—Hill, Van Santen, Steadman & Simpson

[57] ABSTRACT

An automatic lock slider for slide fasteners comprises a slider body including an upper and a lower wing defining therebetween a guide channel for the passage of slide fastener elements, and a first and a second locking member associated with the upper and lower wings, respectively and rotatable in opposite directions into and out of engagement with each other through their respective link arms pivotally connected to the slider body, and a pair of pull tabs operatively associated with the locking members for manipulating the slider selectively from either of its sides.

1 Claim, 7 Drawing Figures

AUTOMATIC LOCKING SLIDER WITH A PAIR OF PULL TABS

BACKGROUND OF THE INVENTION

1. Field of the Invention

This invention relates to a slider for slide fasteners or zippers and more particularly to an automatic locking slider having a pair of pull tabs to enable its operation from either side.

2. Prior Art

Automatic locking slide fastener sliders with double pull tabs are known for their expediency to permit the slider to be manipulated optionally from either of its top and bottom sides to open or close the fastener.

A typical example of such double pull tab sliders is disclosed in Japanese Utility Model Publication 56-37606 in which a slider has a pair of pull tabs operatively associated with a locking prong and a pivotal link, respectively, the locking prong being resiliently movable into and out of the path of slide fastener coupling elements. While this slider is simple in construction, it has a drawback in that since the locking prong and the pivotal link are both borne against the slider body simply by leaf springs, these operative parts are prone to become displaced or misaligned under the influence of stresses exerted to the pull tabs when the latter are moved along the rows of coupling elements, with the results that the locking prong would fail to move back clear out of the path of the coupling elements, or the pivotal link would fail to rotate sufficiently and that therefore the locking prong would impinge upon and damage the fastener elements.

SUMMARY OF THE INVENTION

It is therefore an object of the present invention to provide an improved automatic locking slider for a slide fastener which has a pair of pull tabs operatively associated with a first and a second locking member, respectively, and which incorporates structural features such that both locking members are interconnectable to ensure accurate performance of the slider.

This and other objects and advantages of the present invention will be better understood from the following detailed description taken in connection with the accompanying drawings which illustrate by way of example a preferred embodiment of the invention.

According to the invention, an automatic locking slider includes a first and a second locking member each having a locking prong at one end and a link arm at the other end, said first and second locking members being rotatable in opposite directions into and out of engagement with each other through their respective link arms.

DETAILED DESCRIPTION

Figure 1:
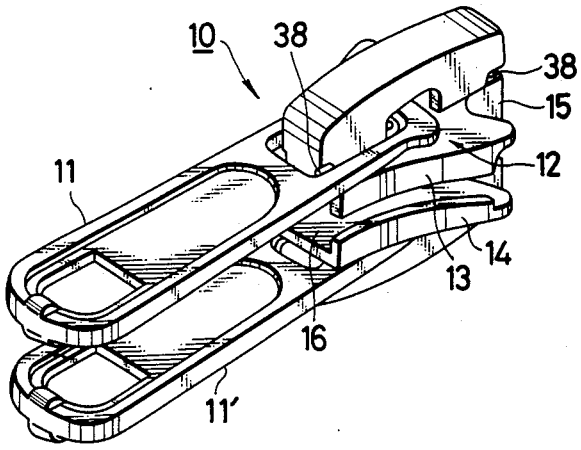
FIG. 1 is a perspective view of a slide fastener slider embodying the invention.

Referring now to the drawings, there is shown a slide fastener slider 10 of an automatically lockable type which is equipped with a pair of pull tabs 11, 11' to be chosen for moving the slider 10 along the rows of coupling elements E (shown by phantom lines in FIG. 2) on the companion fastener stringers F to open or close the fastener in a manner well known in the art. The slider 10 comprises a slider body 12 including a pair of flanged wings 13, 14 superposed one on the other and joined at their one ends by a neck 15 so as to define a substantially Y-shaped guide channel 16 for the passage therethrough of a pair of coupling element rows E on the slide fastener stringers.

As shown in FIGS. 2–5, the upper and lower wings 13 and 14 are provided symmetrically at one end adjoining the neck 15 with outwardly projecting support posts 17 and 18, respectively, which are substantially structurally identical in that they each have a bearing recess 19 for receiving a support pin 20, 20', later described, and a common through opening 21 extending vertically through the neck 15.

Adjacent to the other end of the slider body 12 opposite to the support posts 17, 18, there are support lugs 22, 23 symmetrically disposed at and projecting outwardly from the upper and lower wings 13 and 14, respectively, the upper support lug 22 having an aperture 24 communicating with the guide channel 16.

A first locking member 25 associated with the upper wing 13 of the slider body 12 has at one of its ends a bore 26 (FIG. 5) for receiving the support pin 20, a downwardly extending link arm 27 received within the common opening 21 and at the other end a downwardly projecting locking prong 28 movable into and out of the passageway of the coupling element rows E in the guide channel 16.

A second locking member 29 associated with the lower wing 14 of the slider body 12 has an upwardly extending link arm 30 at one end engageable with the downwardly extending arm 27 of the first locking member 25, a locking prong 31 at the other end disposed in direct opposition to the counterpart 28 of the first member 25 and releasably engageable with the lower wing 14, and a bore 32 adjacent to the arm 30 for receiving the pin 20'.

The first and second locking members 25 and 29 are mounted on the respective wings 13 and 14 through the pins 20, 20' about which they are pivotable so as to move the respective locking prongs 28 and 31 toward and away from each other. The two arms 27 and 30 have abutments 33 and 34, respectively, which are engageable to transmit torque between the two locking members 25 and 29 applied upon manipulation of the pull tabs 11, 11' as hereafter described.

Figure 2:
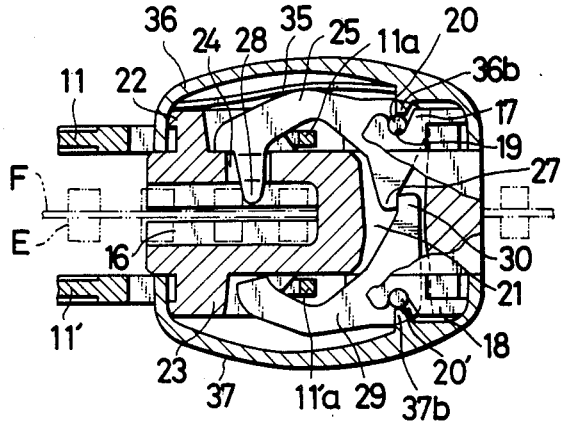
FIG. 2 is a longitudinal cross-sectional view on enlarged scale of the slider of FIG. 1.

A leaf spring 35 has at one of its ends a protuberance 35*a* engageable in a complementary recess (not shown) in an upper housing 36 and at the other end a recess 35*b* engageable with a complementary protuberance (not shown) in the housing 36, the spring 35 normally urging the first locking member 25 downwardly to lock the slider 10 as shown in FIG. 2.

Figure 3:
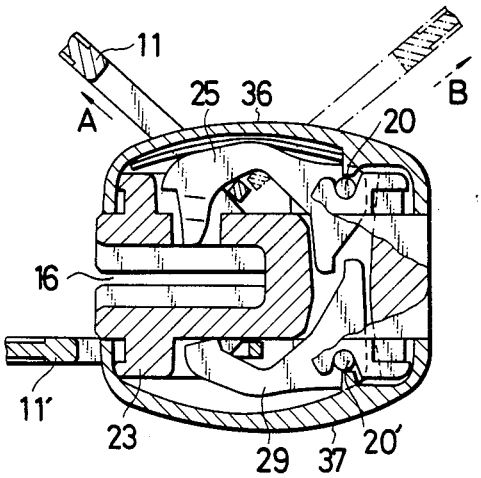
FIG. 3 is a view similar to FIG. 2 but depicting one mode of operation of the slider.
Figure 4:
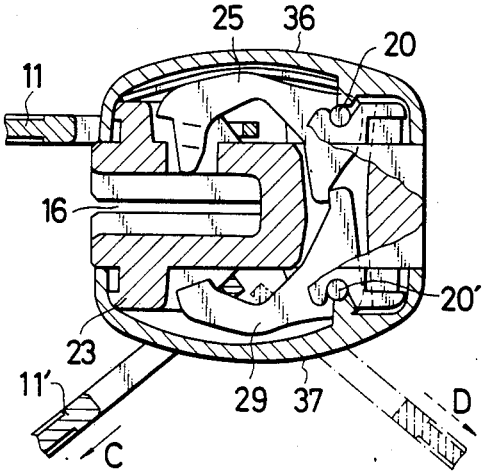
FIG. 4 is a view similar to FIG. 3 but depicting another mode of operation of the slider.
Figure 5:
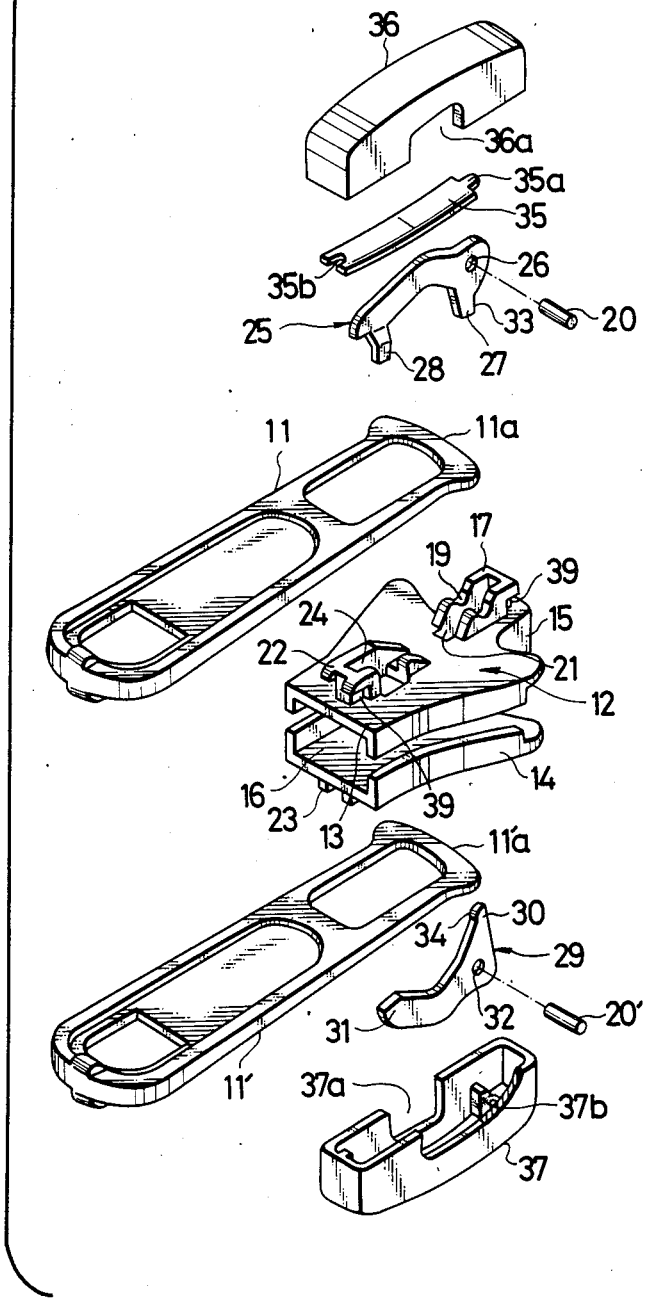
FIG. 5 is an exploded, perspective view of the various parts of the slider.

The pair of pull tabs 11, 11' have their respective trunnions 11*a*, 11'*a* disposed between the upper wing 13 and the first locking member 25 and between the lower wing 14 and the second locking member 29, respectively, and extending transversely across the slider body 12 between the oppositely disposed support posts 17, 18 and support lugs 22, 23, as shown in FIGS. 2–4.

The upper housing 36 and an identical lower housing 37 each have a transverse opening 36*a*, 37*a* through which the trunnions 11*a*, 11′*a* of the pull tabs 11, 11′ are passed to permit pivotal movement of the latter as illustrated in FIG. 3 and 4.

A pin retainer 36*b*, 37*b* is provided at the inner wall of each of the housings 36, 37 for retaining the pin 20, 20′ in position.

As shown in FIG. 1, the upper and lower housings 36 and 37 are mounted over the upper and lower wings 13 and 14, respectively and are secured in place by crimping the material of their corners 38 into side recesses 39 of the posts 17, 18 and the lugs 22, 23.

The operation of the slide fastener slider 10 thus constructed will now be described with reference to FIGS. 2–4. As shown in FIG. 2, both pull tabs 11 and 11′ are laid rearwardly of the slider body 12 flat against the surfaces of the upper and lower wings 13 and 14, respectively, in which condition the first locking member 25 is urged by the spring 35 to let its prong 28 move toward and rest between the fastener elements E thereby locking the slider 10 against movement relative to the fastener.

FIG. 3 illustrates one mode of operation of the slider 10 in which the upper pull tab 11 is lifted to pull the slider 10 either in the direction of A to open the fastener, or in the direction of B to close the fastener. When thus lifting or rotating the pull tab 11 clockwise, the upper locking member 25 rotates about the pin 20 with its prong 28 retracted away from the passageway or guide channel 16 against tension of the spring 35, in which instance the upper locking member 25 and the lower locking member 29 are disengaged at their respective abutments 33 and 34.

FIG. 4 illustrates another mode of operation in which the lower pull tab 11′ is used to operate the slider 10 in the direction of either C or D.

With the upper pull tab 11 first set in rest position, the lower pull tab 11′ is lifted, causing the lower locking member 29 to rotate counterclockwise about the pin 20′ until the upper locking member 25 is urged via linkage of cooperating abutments 33, 34 to rotate clockwise about the pin 20 against tension of the spring 35 thereby retracting the locking prong 28 from the guide channel 16.

Figure 6A:
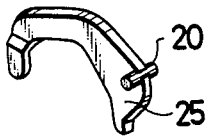
FIG. 6(*a*) and FIG. 6(*b*) are perspective views of modifications of the locking prong and the pivotal link, respectively.
Figure 6B:
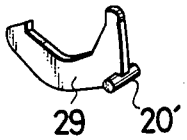

While, in the foregoing embodiment, the locking members 25 and 29 are pivotable about the respective pins 20 and 20′ which are stationary, these pins may be conveniently formed integrally with the respective locking members as shown in FIG. 6, which may be done by injection molding or by die-casting.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An automatic locking slider for a slide fastener having a pair of rows of coupling elements, said slider comprising:

(a) a slider body including a pair of upper and lower flanged wings joined at one end by a neck to define therebetween a substantially Y-shaped guide channel for the passage therethrough of the pair of rows of coupling elements, each of said wings having a support post at one end adjoining said neck, each support post having a recess, said slider body having a through opening extending through said neck and said two support posts;

(b) a pair of first and second locking members supported on said upper and lower wings, respectively, and each mounted on a pivot pin rockably received in said recess of a respective one of said support posts, said upper locking member having at one end a locking prong projectable into and retractable from said guide channel in response to pivotal movement of said upper locking member, and at the other end a first link arm projecting into said through opening, said lower locking member having at one end a second link arm projecting into said through opening and engageable with said first link arm in response to pivotal movement of said second locking member;

(c) a pair of first and second housings mounted on said upper and lower wings, respectively, and each having a pin retainer projecting from an inner wall of each of said first and second housings for retaining said pivot pin of each of said first and second locking members in the respective recess;

(d) a leaf spring acting between said first housing and said first locking member for normally urging the latter to pivotally move in such a direction that said locking prong projects into said guide channel; and (e) a pair of pull tabs operatively connected to said first and second locking members, respectively, for pulling the respective locking members so as to pivotally move the same against the bias of said leaf spring in such direction that said locking prong is retracted from said guide channel.

* * * * *